US007810662B2

(12) United States Patent
DeLong

(10) Patent No.: US 7,810,662 B2
(45) Date of Patent: Oct. 12, 2010

(54) NURSERY BOTTLE WITH AUTOMATIC SHUT OFF MECHANISM FOR INHIBITING TOOTH DECAY

(76) Inventor: David DeLong, P.O. Box 7916, Tacoma, WA (US) 98406-0916

( * ) Notice: Subject to any disclaimer, the term of this patent is extended or adjusted under 35 U.S.C. 154(b) by 827 days.

(21) Appl. No.: 11/678,509

(22) Filed: Feb. 23, 2007

(65) Prior Publication Data

US 2008/0203050 A1 Aug. 28, 2008

(51) Int. Cl.
*A61J 9/00* (2006.01)

(52) U.S. Cl. ..... 215/11.4; 215/11.1; 215/386.6; 215/387; 215/388; 215/391

(58) Field of Classification Search ..... 215/11.4, 215/11.1, 386, 6, 387, 388, 391, DIG. 5; 119/72.5, 51.11, 51.5, 71
See application file for complete search history.

(56) References Cited

U.S. PATENT DOCUMENTS 3,192,902 A * 7/1965 Gammill ..... 119/51.11
3,307,521 A * 3/1967 Tavera et al. ..... 119/71
4,054,026 A * 10/1977 Goodrich ..... 368/93
4,055,147 A * 10/1977 Fletcher et al. ..... 119/72.5
4,856,995 A * 8/1989 Wagner ..... 433/215
5,938,053 A * 8/1999 Verbovszky et al. ..... 215/6
5,960,971 A * 10/1999 Bral ..... 215/11.4
6,588,593 B2 7/2003 Woskoski
7,111,760 B2 * 9/2006 Pagovich et al. ..... 222/158
7,150,369 B1 * 12/2006 Fryar ..... 215/11.4
7,500,576 B1 * 3/2009 Alvarez ..... 220/212
7,515,507 B2 * 4/2009 Nanda ..... 368/10
2004/0188372 A1 * 9/2004 Ruth et al. ..... 215/11.4
2006/0062085 A1 * 3/2006 Evans ..... 368/10

* cited by examiner

*Primary Examiner*—Anthony Stashick
*Assistant Examiner*—Cynthia F Collado
(74) *Attorney, Agent, or Firm*—Citadel Patent Law; George A. Leone

(57) ABSTRACT

A nursery bottle with an automatic shut off mechanism for inhibiting tooth decay. A nipple is attached to a shut off valve, and the shut off valve is attached to a bottle body. The nipple, the bottle body and the shut off valve are in fluid communication with each other. The shut off valve includes a timing mechanism, where the timing mechanism is coupled to a reset actuator that operates the timing mechanism to open the shut off valve for a feeding time period, and where the shut off valve closes to shut off fluid flow into the nipple after the feeding time period expires.

9 Claims, 6 Drawing Sheets

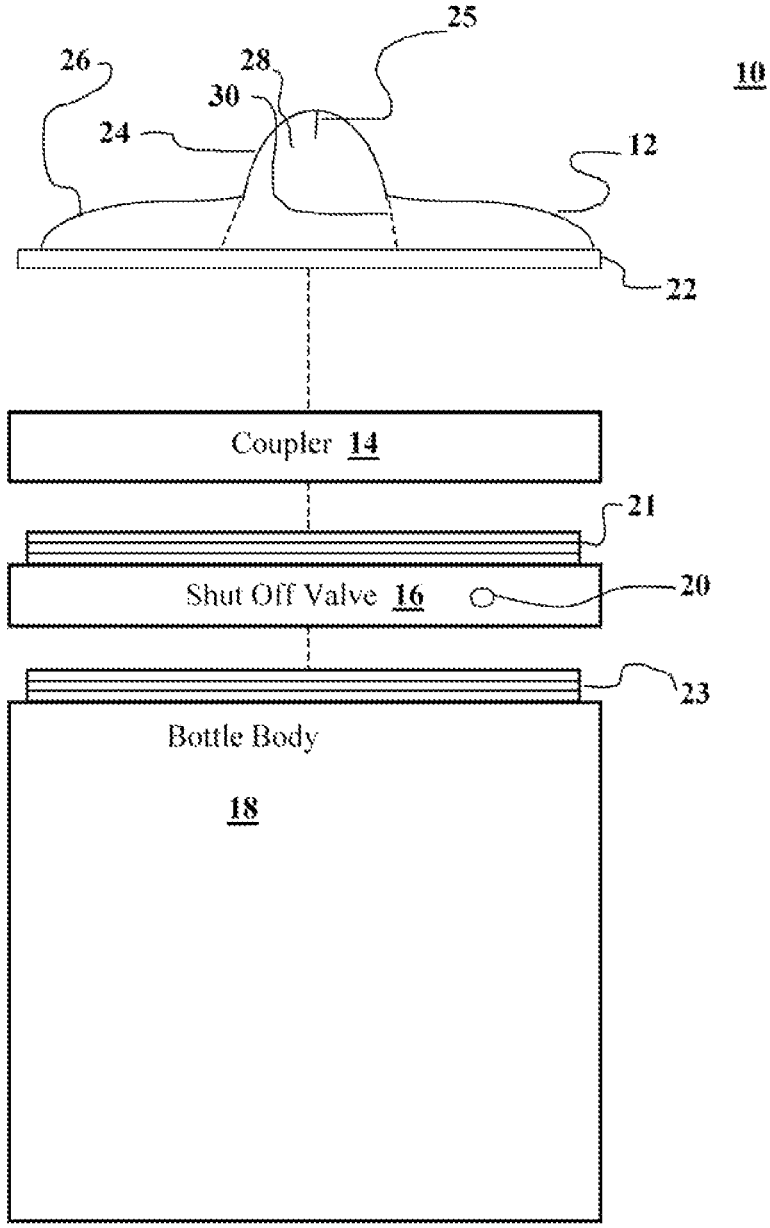
FIG. 1
FIG. 1A
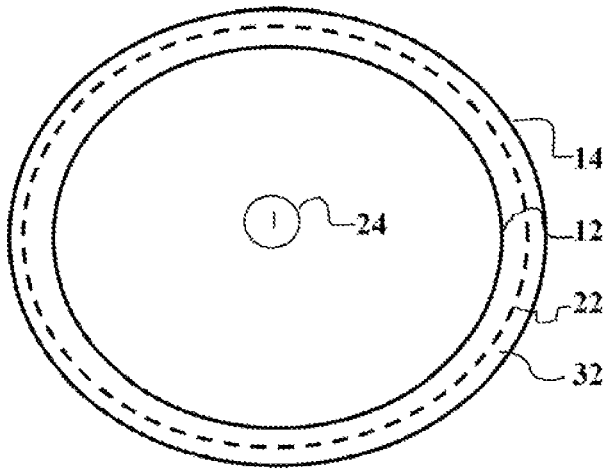

NURSERY BOTTLE WITH AUTOMATIC SHUT OFF MECHANISM FOR INHIBITING TOOTH DECAY

FIELD OF THE INVENTION

The present invention relates to prevention of infant tooth decay, in general, and, more particularly, to a nursery bottle for inhibiting baby bottle tooth decay.

BACKGROUND OF THE INVENTION

Infant tooth decay, especially that known as "baby bottle tooth decay," is a severe public health problem that affects infants and toddlers. According to the American Dental Association (ADA), decay occurs when sweetened liquids are given and are left clinging to an infant's teeth for long periods. Many sweet liquids cause problems, including milk formula and fruit juice. Bacteria in the mouth use these sugars as food. They then produce acids that attack the teeth. Each time a child drinks these liquids, acids attack for 20 minutes or longer. After many attacks, the teeth can decay. In the United States, for example, as many as 1 in 20 children suffer from infant tooth decay.

Efforts to combat baby bottle tooth decay have focused on changing the behavior of parents. The ADA recommends that parents do not put children to bed with a bottle. The ADA further recommends that parents wipe the infant's teeth and gums with a soft cloth to remove decay organisms and nutrients that aid in their growth. These preventive measures are not well accepted by parents. In many situations, parents of infants may be generally exhausted and want to sleep as much as they want their babies to sleep. In a midnight feeding, parents may forego proper procedures by leaving a bottle in an infant's mouth for a prolonged period extending well after the infant has fallen asleep.

Since admonishments from the ADA and other health professionals require behavioral changes, such admonishments often go unheeded. Baby bottle tooth decay remains a serious public health problem. As a result there is a need for devices to address the issue of infant tooth decay, particularly the type known as baby bottle tooth decay.

The present invention, for the first time, provides a new and novel device for feeding babies at night while inhibiting prolonged exposure of teeth to nutrient rich bacterial growth media.

SUMMARY OF THE INVENTION

The present invention provides a nursery bottle with an automatic shut off mechanism for inhibiting tooth decay. A nipple is attached to a shut off valve, and the shut off valve is attached to a bottle body. The nipple, the bottle body and the shut off valve are in fluid communication with each other. The shut off valve includes a timing mechanism, where the timing mechanism is coupled to a reset actuator that operates the timing mechanism to open the shut off valve for a feeding time period, and where the shut off valve closes to shut off fluid flow into the nipple after the feeding time period expires.

It is one object of the invention to provide a device that is fastened onto the top of a traditional baby bottle container having a valve between the bottle reservoir and the nipple, where the valve's function is controlled by a timer that can be set to a baby's typical feeding time. When the time expires, the valve shuts to prevent fluid from leaking or being sucked into the baby's mouth.

One aspect of the invention features a valve, a timer and a low volume nipple to shut off the flow of fluid after a preset time.

BRIEF DESCRIPTION OF THE DRAWINGS

FIG. 1 schematically illustrates an exploded view of one example of a nursery bottle with an automatic shut off mechanism for inhibiting tooth decay as employed in one embodiment of the invention.

FIG. 1A schematically illustrates a top view of one example of a nursery bottle with an automatic shut off mechanism for inhibiting tooth decay as employed in one embodiment of the invention.

DETAILED DESCRIPTION OF THE PREFERRED EMBODIMENTS

Figure 3:
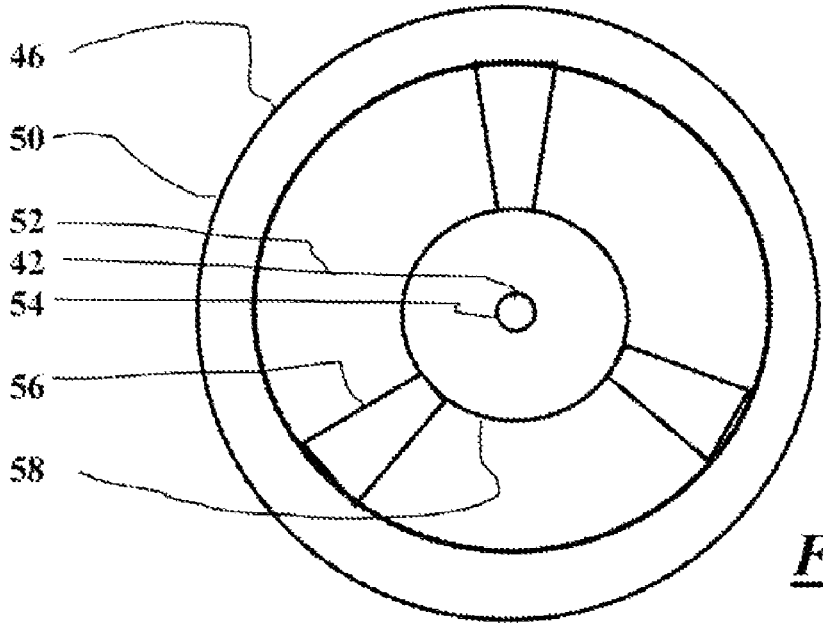
FIG. 3 schematically shows a detailed top view of a outlet element used in an automatic shut off valve as employed in one embodiment of the invention.

Referring now to FIG. 1 there schematically shown is an exploded view of one example of a nursery bottle with an automatic shut off mechanism for inhibiting tooth decay as employed in one embodiment of the invention. A nursery bottle 10 includes a coupler 14 that connects a nipple 12 to a shut off valve 16. The shut off valve 16 in turn is configured to be attached to a bottle body 18.

In one embodiment the nipple 12 comprises a low volume nipple including a lip 22, a fluid reservoir 28, a protruding nub 24 with an opening 25 and a solid portion 26. As indicated by the dashed lines 30, the solid portion 26 surrounds the fluid reservoir 28 in order to limit the amount of fluid held in the nipple 12.

One skilled in the art and having the benefit of this novel disclosure will appreciate that the nipple 12, including the solid portion 26 may be made of any conventional material suitable for use in baby bottle nipples. Other parts including the bottle body and valve housing may be constructed using plastic, other suitable materials well known in the art and the like. Parts may be molded extruded or otherwise constructed according to conventional manufacturing principles.

Figure 2:
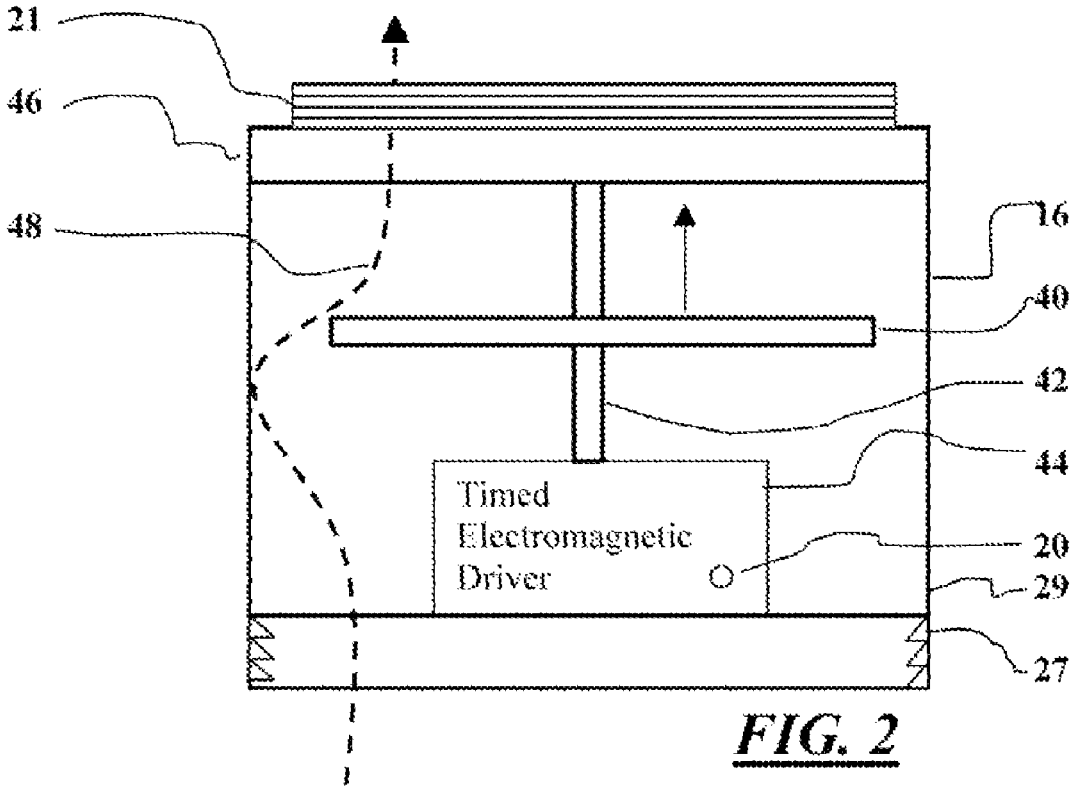
FIG. 2 schematically shows a partial out away view of an automatic shut off valve as employed in one embodiment of the invention.

The shut off valve 16 includes a first threaded portion 21 constructed to receive the coupler 14, which includes mating threads (not shown) for screwing onto the first threaded portion 21. A reset actuator 20 is connected to the shut off valve. The bottled body 18 may comprise any conventional bottle body having a second threaded portion 23. The shut off valve further includes interior threads 27 (as best shown in FIG. 2) for mating with the second threaded portion 23 in order to attach the shut off valve 16 to the bottle body 18. When assembled, the nipple 12 is retained by the coupler 14. The coupler 14 attaches to the shut off valve 16 which, in turn, mates to the bottle body 18.

Referring now to FIG. 1A there schematically shown is a top view of one example of a nursery bottle with an automatic shut off mechanism for inhibiting tooth decay as employed in one embodiment of the invention. There shown is the coupler 14 having a collar 32. The lip 22 is retained by the collar 32 so as to attach the nipple 12 to the shut off valve 16 when the coupler 14 is mated to the shut off valve 16.

Referring now to FIG. 2 there schematically shown is a partial cut away view of an automatic shut off valve as employed in one embodiment of the invention. The shut off valve 16 includes valve housing 29 enclosing a timed electromagnetic driver 44. Attached to or integral with the housing 29 is an outlet element 46. The timed electromagnetic driver 44 is further coupled to a shaft 42. When the timed electromagnetic driver 44 is in a default mode, the shaft 42 is coupled to drive a shut off cover 40 into contact with the outlet element 46 to shut off liquid flow into the nipple. As described in more detail below, operating reset actuator 20 activates the timed electromagnetic driver 44 to open during a feeding time period and automatically close thereafter.

Referring now to FIG. 3 there schematically shown is a detailed top view of an outlet element used in an automatic shut off valve as employed in one embodiment of the invention. The outlet element 46 includes a ring 50, a disc 58 and a plurality of disc mounts 56. The plurality of disc mounts 56 extends radially from the disc to join the disc to the ring. At least one fluid flow port 52 is located between at least one pair of disc mounts 56. In a preferred embodiment, each pair of disc mounts 56 brackets a fluid flow port 52. The disc 58 further includes an opening 54 located and sized to snugly accommodate the shaft 42 so that the shaft can move through the opening 54 thereby moving the cover to open or close the shut off valve.

In some embodiments attachment elements may be optionally deleted. For example, the nipple may be integrated with the shut off valve, thereby eliminating the need for coupler 14. Other embodiments integrating the functions of various elements such as the shut off valve and bottle body are also contemplated by and are considered within the scope of the invention.

Having described the construction of one embodiment of the invention, a description of the operation of one example of the invention follows to promote further understanding of the invention. Referring again to FIG. 1 through FIG. 3, fluid flow due to gravity from the bottle body 18, through the shut off valve 16 to the nipple is generally indicated by directional arrow 48. When the shut off valve is reset, the shut off cover 40 is positioned away from the outlet element 46 to allow fluid to flow around the shut off cover 40 and through the ports 52 into the nipple 12. The reset actuator 20 is coupled to open the valve by activating a magnetic force to retract the drive shaft and the shut off cover 40. Activating the reset actuator starts a timer for a pre-selected and/or operator adjustable time period. When the time period expires, the valve is set to a default mode. In the default mode the shut off cover is driven by, for example, spring action from the electromagnetic driver 44 pushing shaft 42 to close the ports 52 by impinging the shut off cover 40 against the outlet element 46. Thus fluid flow from the bottle body 18 to the nipple is substantially stopped by the shut off valve 16.

The timed electromagnetic driver 44 may be any conventional electromagnetic device such as a solenoid or similar mechanism and its associated battery power and timing electronics. The timed electromagnetic driver housing 29 may advantageously comprise a sealed, dishwasher-safe housing to protect the drive electronics and mechanical components. The timed electromagnetic driver 44 may be mounted to the housing 29 with the reset actuator 20 protruding through the housing for access. A suitable seal, such as an O-ring may be used to prevent leakage through the reset actuator into the driver assembly.

The example embodiments described herein are intended to demonstrate the principles of the invention and the invention is not so limited. For example, a mechanical spring activated device may alternately be used in place of the timed electromagnetic driver 44. Alternative switches may be used for the reset actuator such as conventional timing dials, push buttons, slide switches or the like for resetting a spring mechanism with a timed release. In some embodiments it may be advantageous to have adjustable time periods or selected preset time periods that may be activated by the reset actuator and/or additional switches. Although not shown here, a display of the feeding time period may be included on the exterior of the valve housing.

Figure 4:
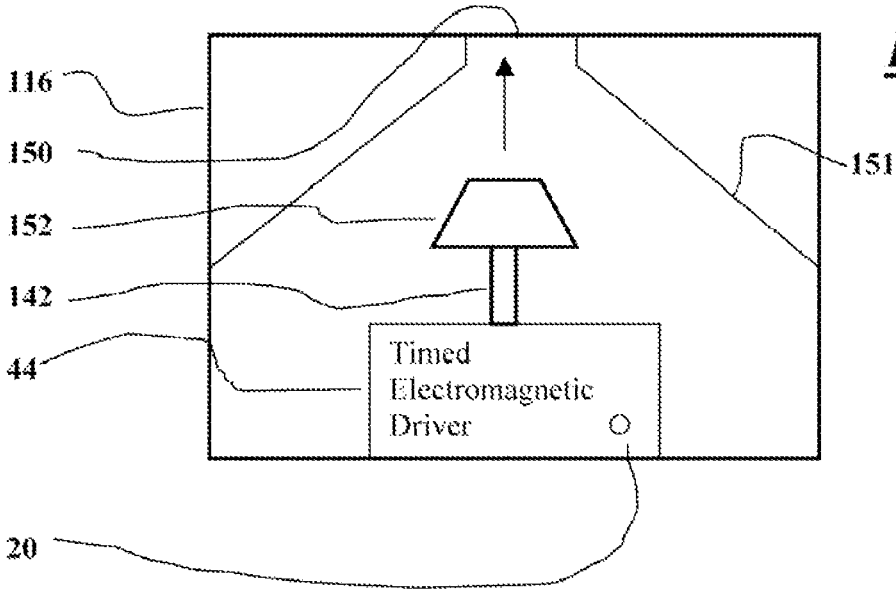
FIG. 4 schematically shows a cut away side view of an alternate embodiment of an automatic shut off mechanism as contemplated by the invention.

Referring now to FIG. 4 there schematically shown is a cut away view of an alternate embodiment of an automatic shut off mechanism as contemplated by the invention. A shut off valve 116 is constructed substantially similarly to the shut off valve described above. However, the alternative shut off valve 116 differs from the other embodiments in that the outlet element here comprises a fluid port 150 centered at the outlet end of the housing. An interior housing wall 151 is configured so that the housing has a funnel-shaped conical or beveled interior to direct fluid to the fluid port 150. A timed electromagnetic driver 44 is coupled to a shaft 142 having a plunger 152 at one end. The plunger 152 is sized to plug the fluid port 150 when the shut off valve 116 is in the set position and to retract upon resetting and opening the shut off valve.

Figure 5:
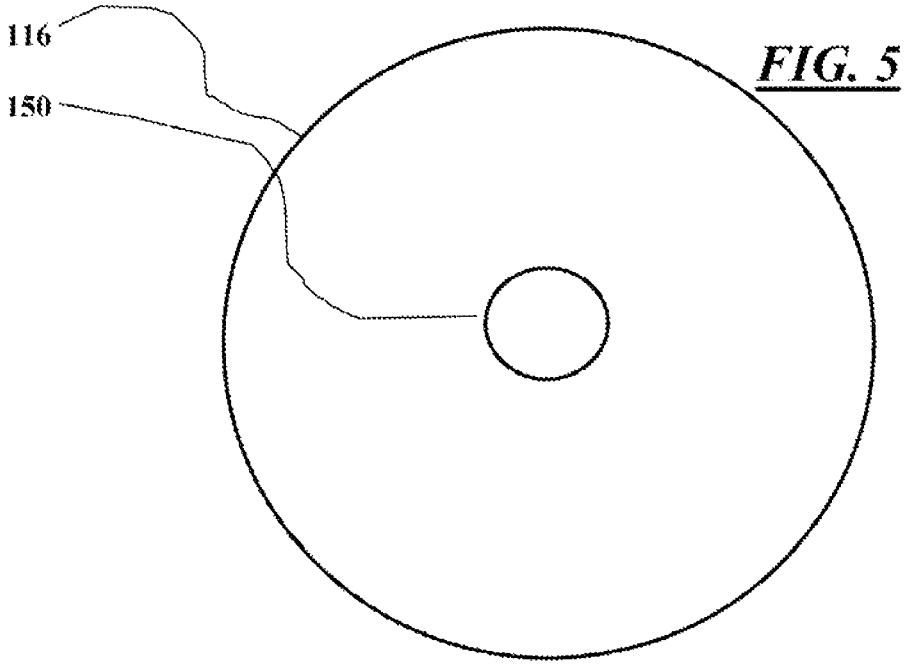
FIG. 5 schematically shows a top view of an alternate embodiment of a shut off valve.

Referring now to FIG. 5 there schematically shown is a top view of an alternate embodiment of a shut off valve. The shut off valve 116 allows fluid to flow through the fluid port 150 for a selected time period when a bottle is tilted for feeding and the shut off valve is reset.

Figure 6:
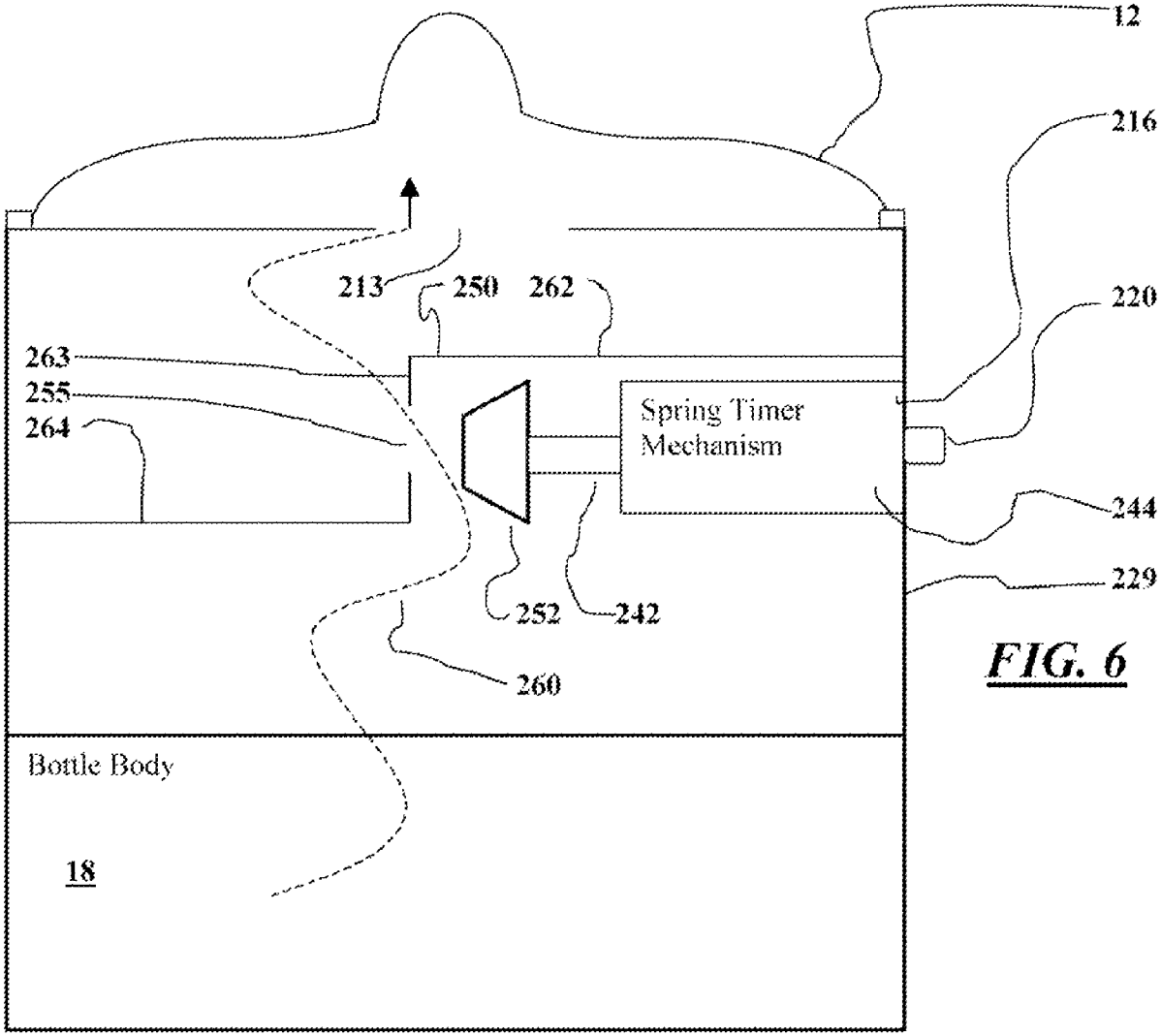
FIG. 6 schematically shows a cut away side view of another alternate embodiment of an automatic shut off mechanism as contemplated by the invention.

Referring now to FIG. 6 there schematically shown is a cut away view of another alternate embodiment of an automatic shut off mechanism as contemplated by the invention. A shut off valve 216 comprises a valve housing 229 including a fluid outlet 213 at an outlet end. A spring timing mechanism 244 having a shaft 242, a reset button 220 and a plunger 252 attached to the shaft 242 is mounted to the valve housing 229. An interior separator 250 is constructed within the shut off valve housing 229. The separator 250 is constructed to divide the valve housing into two portions and has a port 255 located and sized to receive the plunger 252 when the shut off valve is in a set or closed position. In one example the separator 250 comprises a first partition 262 extending inwardly from the housing 229, a second partition 264 extending inwardly from the housing 229 and offset from the first partition 262, and a third partition 263 extending perpendicularly between the first and second partitions and joining the first and second partitions. The third partition 263 includes the fluid port 255. The spring timing mechanism 244 moves the shaft 242 and plunger 252 to plug the fluid port 255 when the shut off valve 216 is in the set position. The direction of fluid flow due to gravity is generally indicated by dashed line 260.

Figure 7A:
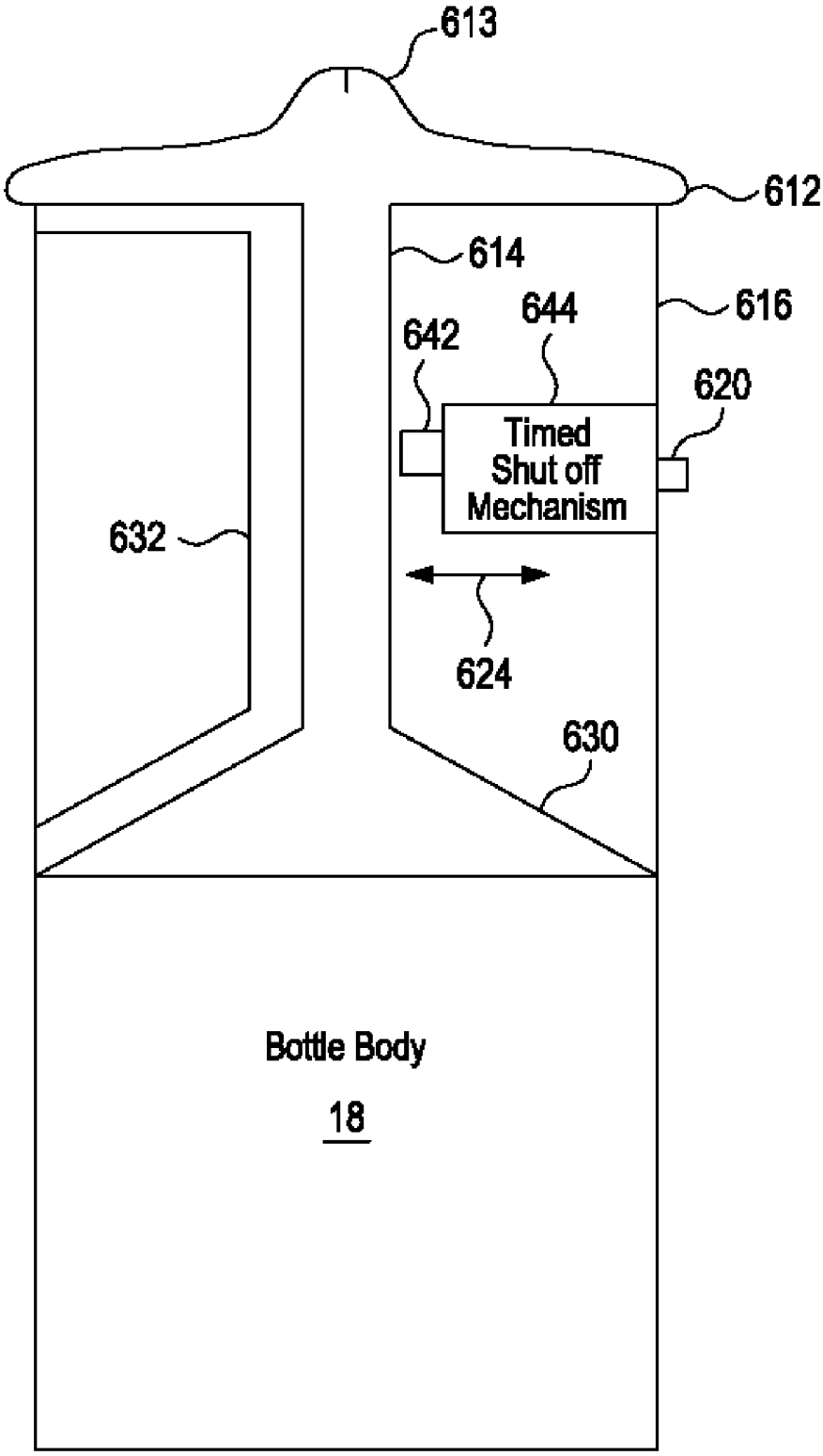
FIG. 7A schematically shows a cut away side view of yet another alternate embodiment of an automatic shut off mechanism as contemplated by the invention.

Referring now to FIG. 7A there schematically shown is a cut away side view of yet another alternate embodiment of an automatic shut off mechanism as contemplated by the invention. A valve housing 616 supports a nipple 612 having a nub 613. A wall 632, a timed shut off mechanism 644 having a reset switch 620 and a flow restrictor 642 are mounted within the valve housing 616. As with the above embodiments the flow restrictor 642 may comprise a plunger that operates to retract when the valve is reset and extend when the shut off mechanism times out, as generally indicated by double arrow 624. The nipple 612 includes an elongated neck 614 and an opened bottom 630 for guiding fluid into the neck 612 and ultimately to the nub 613. The valve housing is adapted to be coupled to, for example, a standard bottle body substantially similarly to the other embodiments described herein.

Figure 7B:
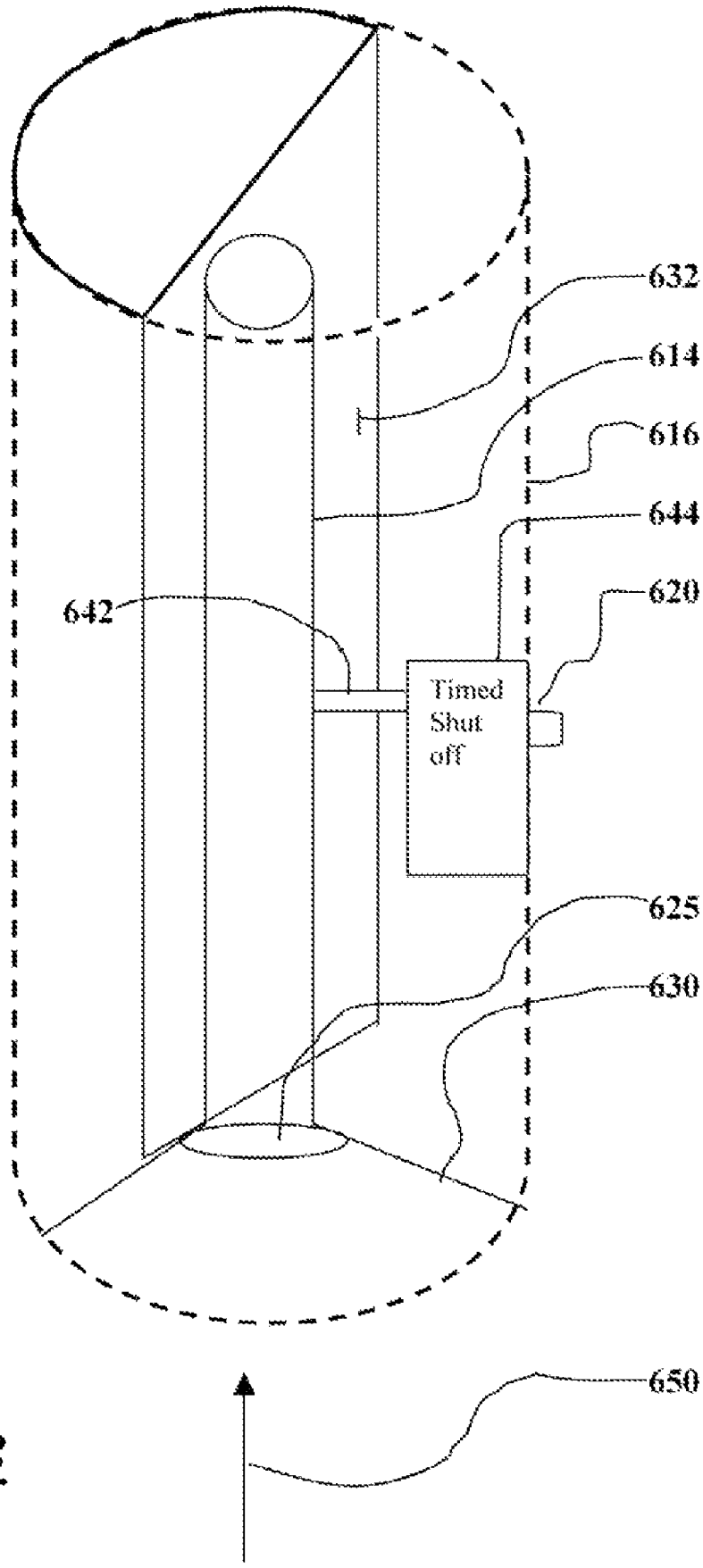
FIG. 7B schematically shows an interior perspective view of a detail of the shut off valve used in the embodiment of FIG. 7A.

Referring now to FIG. 7B there schematically shown is an interior perspective view of a detail of the shut off valve used in the embodiment of FIG. 7A. The neck 614 forms a fluid channel having an input port 625 joining the bottom 630 so that the nipple is in fluid communication with the bottle body as indicated by arrow 650. In one embodiment the bottom 630 may be substantially funnel shaped, although other shapes may also be used.

Referring now jointly to FIG. 7A and FIG. 7B, in operation, the shut off mechanism when activated drives the plunger 642 into the neck 614, thereby pinching the neck 614 against the wall 632 and stopping fluid from reaching the nub. In another embodiment the plunger may be replaced by a fork that straddles the elongated neck and is rotated by the timed shut off mechanism to pinch off fluid flow to the nub.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment, and devices, and that various modifications, both as to the equipment details and operating procedures, may be accomplished without departing from the true spirit and scope of the present invention.

What is claimed is:

1. A nursery bottle with an automatic shut off mechanism for inhibiting tooth decay comprising:

a bottle body;

a nipple; and a shut off valve, where the nipple is attached to the shut off valve and the shut off valve is attached to the bottle body, where the nipple, the bottle body and the shut off valve are in fluid communication with each other, and where the shut off valve includes a timing mechanism, where the timing mechanism is coupled to a reset actuator that operates the timing mechanism to open the shut off valve for a feeding time period, and where the shut off valve closes to shut off fluid flow into the nipple after the feeding time period expires;

and wherein the shut off valve further includes a valve housing enclosing the timing mechanism, an outlet element located at one end of the valve housing, where the timing mechanism is coupled to one end of a shaft, and where the shaft is attached to a shut off cover located above the timing mechanism, such that when the timing mechanism is set in a default mode, the shaft holds the shut off cover in close contact with the outlet element to shut off liquid flow into the nipple.

2. The nursery bottle of claim 1 further including a coupler for attaching the nipple to the shut off valve.

3. The nursery bottle of claim 1 wherein the nipple comprises a low volume nipple.

4. The nursery bottle of claim 3 wherein the nipple includes a fluid reservoir and a solid portion, where the solid portion surrounds the fluid reservoir in order to limit the amount of fluid held in the nipple.

5. The nursery bottle of claim 1 where the valve housing comprises a sealed housing.

6. The nursery bottle of claim 1 where the timing mechanism is selected from the group consisting of a timed electromagnetic driver, a spring mechanism with a timed release and a solenoid.

7. The nursery bottle of claim 1 where the feeding time period comprises an adjustable time period.

8. The nursery bottle of claim 1 where the feeding time period comprises a selected one of a plurality of preset time periods.

9. The nursery bottle of claim 1 wherein the timing mechanism comprises a timed electromagnetic driver.

* * * * *